US006942301B2

(12) United States Patent
Brandl et al.

(10) Patent No.: US 6,942,301 B2
(45) Date of Patent: Sep. 13, 2005

(54) METHOD FOR BORING AND PLACING BOLTS FOR IMBEDDING ADHESIVELY AND DEVICE FOR CARRYING OUT THIS METHOD

(75) Inventors: Erich Brandl, Grosslobming (AT); Kurt Schaffer, Seckau (AT); Alfred Marek, St. Lorenzen (AT); Gerald Essl, Leoben (AT)

(73) Assignee: Voest-Alpine Bergtechnik Gesellschaft m.b.H., Zeltweg (AT)

( * ) Notice: Subject to any disclaimer, the term of this patent is extended or adjusted under 35 U.S.C. 154(b) by 16 days.

(21) Appl. No.: 10/363,875

(22) PCT Filed: Aug. 31, 2001

(86) PCT No.: PCT/AT01/00277

§ 371 (c)(1),
(2), (4) Date: Mar. 6, 2003

(87) PCT Pub. No.: WO02/20946

PCT Pub. Date: Mar. 14, 2002

(65) Prior Publication Data

US 2004/0021363 A1 Feb. 5, 2004

(30) Foreign Application Priority Data

Sep. 11, 2000 (AT) ..... 1540/2000

(51) Int. Cl.[7] ..... E21D 23/00
(52) U.S. Cl. ..... 299/33; 299/11; 405/302
(58) Field of Search ..... 299/11, 33; 405/288, 405/291, 302

(56) References Cited

U.S. PATENT DOCUMENTS

| | | | | | |
|---|---|---|---|---|---|
| 4,297,057 | A | * | 10/1981 | O'Neil | 405/303 |
| 4,655,507 | A | * | 4/1987 | Wechner | 299/33 |
| 4,740,037 | A | * | 4/1988 | Eager et al. | 299/45 |
| 4,753,486 | A | * | 6/1988 | LeBegue | 299/11 |
| 4,832,536 | A | * | 5/1989 | Spross et al. | 405/303 |
| 4,865,390 | A | * | 9/1989 | Shrader et al. | 299/11 |
| 4,953,914 | A | * | 9/1990 | LeBegue | 299/4 |

FOREIGN PATENT DOCUMENTS

| | | | | |
|---|---|---|---|---|
| AT | 367 524 | | 11/1982 | E21B/20/00 |
| EP | 0 207 056 | A1 | 12/1986 | E21D/21/00 |
| GB | 2210081 | * | 6/1989 | |
| GB | 2 268 526 | A | 1/1994 | E21D/20/00 |

* cited by examiner

*Primary Examiner*—Sunil Singh
(74) *Attorney, Agent, or Firm*—Chapman and Cutler LLP

(57) ABSTRACT

A method and device for drilling and setting adhesive anchor bolts close to the mine face during the cutting operation of a tunneling or mining machine which is capable of being displaced on a traveling mechanism and includes a cutting cylinder or cutting head rotationally mounted on a cantilever arm pivotable in a vertical direction, and optionally in a horizontal direction. The method is carried out in a manner where the substantially horizontal forward movement of the cantilever arm at break-in cutting is detected and a signal is generated during break-in cutting to block commencement of a working cycle for drilling and anchoring. A controller (16) for excavation of material on the mine face is networked with a controller (15) for actuation of the anchor drilling and setting device (10) via radio, electrical or optical lines (17).

31 Claims, 2 Drawing Sheets

Figure 1:
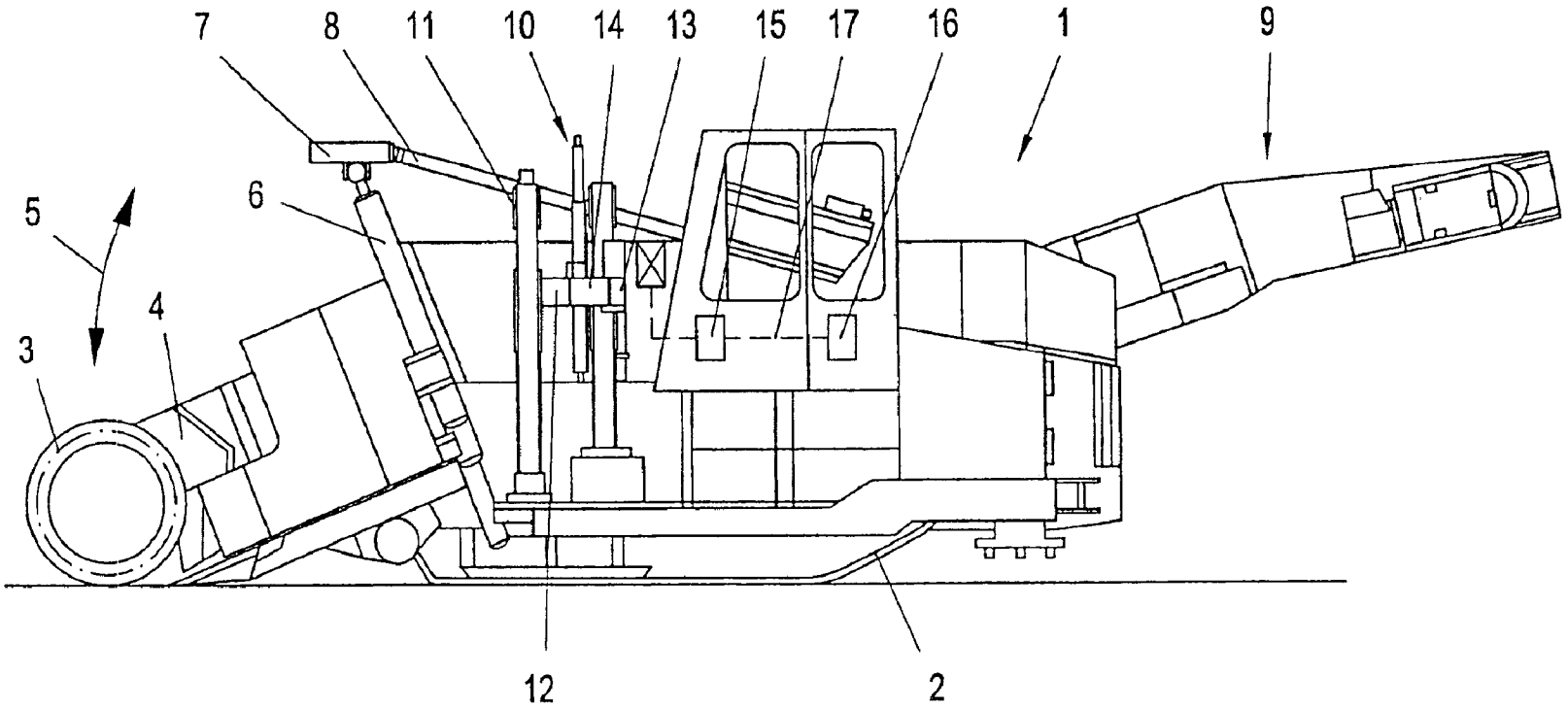

METHOD FOR BORING AND PLACING BOLTS FOR IMBEDDING ADHESIVELY AND DEVICE FOR CARRYING OUT THIS METHOD

The invention relates to a method for drilling and setting adhesive anchor bolts close to the mine face during the cutting operation of a tunneling or mining machine which is capable of being displaced on a traveling mechanism and includes a cutting cylinder or cutting head rotationally mounted on a pivotable cantilever arm and pivotable in the vertical direction, and optionally also in the horizontal direction, as well as a device for carrying out this method.

Tunneling machines with integrated anchor drilling and setting devices are, for instance, described in WO 99/14463. In that known machine at least one support capable of being braced between the roof and the floor is provided near the mine face. In order to improve the support relative to the machine frame, an articulated strut is additionally provided, by which the support is hinged to the rear portion of the machine. In principle, such a device enables anchoring near the mine face. Yet, the quality of the anchor bore is, of course, limited on account of vibrations of the machine frame, an effective support being feasible only relative to the machine frame and the machine frame itself being subject to vibrations during tunneling or material working as a function of the respectively chosen cutting parameters. Supports of that type are only insufficiently able to take up horizontal forces. During break-in cutting, the cantilever arm is moved in the direction towards the mine face along with the cutting tools, and in that phase of the cutting procedure the reaction forces have to be taken up as frictional forces on the respective bracings and, in particular, on the crawler mechanism and on the roof bar, respectively. If, as usually happens with a mining process, the break-in cutting procedure is started close to the roof and the mining or excavation cycle takes place subsequently by a vertical downward movement of the cantilever arm, the respective reaction forces will then be substantially better absorbed by application forces of the traveling mechanism on the floor, so that even the bracing provided near the mine face can be kept free of vibrations more easily. However, the troublefree operation of the anchor drilling and setting devices is not readily ensured at any time during the cutting procedure, particularly when winning hard coal or cutting hard rock. It was, therefore, proposed to design the anchor boring and setting device so as to be completely independent of the tunneling or mining machine and displace it separately, such a device being, for instance, described in U.S. Pat. No. 4,229,124. A device of this type is suitable for the introduction of adhesive anchor bolts, such a completely separate realization of the anchor drilling and setting device from the advance working machine rendering feasible a high degree of automation.

Anchor drilling and setting devices capable of being largely automated are basically known. EP-A1-0 124 658, for instance, describes an anchor drilling and setting device of this type, by which a remote control of the individual steps required, namely drilling, inserting the adhesive cartridges and mounting the anchor, is feasible in order to thereby enable the operating personnel to keep off the unprotected roof region. Yet, a cantilever arm arranged on a separately movable drill carriage is also provided in that device. U.S. Pat. No. 4,165,789 describes an anchor drilling and setting device controlled by a microcomputer, in which any risk of damage to the drill head or bending of the drill rod assembly is to be avoided by the appropriate incremental alteration of the parameters for the drilling process. With such a relatively complex control, the advance movement and number of revolutions of the drilling device are each monitored and, while keeping constant one of those two parameters, e.g. the advance movement, the other parameter, e.g. the number or revolutions, is changed in increments in order to thereby achieve the maximum drilling performance. A device of this type cannot be directly arranged on an advance working machine either, since the parameters selected to optimize the drilling performance for the setting of the anchors will in no way take into account the respective operating parameters of the cutting machine.

Finally, an anchor drilling and setting device which is directly connected with the frame of a tunneling or driving machine is described in GB 2 210 081 A. The decoupling of movements of the machine frame in that case is proposed to be accomplished by the telescopic design of the support of the anchor drilling and setting device relative to the machine frame, whereby a device of this type can naturally be used only on the rear end of a machine such that the distance between the mine face and the site on which an effective anchorage can be realized will become relative large.

The invention aims to provide a method and device of the initially defined kind, by which drilling and setting anchor bolts close to the mine face can be effected in an automated manner without entailing impairments by the largely simultaneous advance working of the track or winning of material. The method according to the invention, in particular, is to offer the opportunity to increase the safety near the mine face by substantially simpler and quicker control means for the anchor drilling and setting devices.

To solve this object, the method according to the invention is essentially characterized in that the substantially horizontal movement of the cantilever arm at break-in cutting is detected and a signal is generated during break-in cutting to block the start of a working cycle for drilling and anchoring. By detecting the parameters that are critical for a safe anchorage and support of the anchor drilling and setting device during the cutting procedure or advance working process, and blocking the operation of anchor drilling and setting devices only if a safe support is not guaranteed, the time available for the precise introduction of anchors near the mine face is substantially extended. According to the invention, only that period of time over which the cutting cylinder or cutting tools are advanced into the mine face is thus factored out, since a precise anchor bore appears uncertain and likely to be impeded merely during the horizontal movement of the cantilever arm or machine into the mine face on account of the high reaction forces occurring in the event of hard rock or hard coal. During the excavation process, in which the cantilever arm is moved in the vertical direction from the roof to the floor, the reaction forces are reliably taken up via the traveling mechanism of the advance working machine or winning machine, and a machine support arranged close to the mine face can thus be effectively kept free of vibrations and movements so as to enable the making of precise bores without involving any expensive monitoring of the drilling parameters of the anchor drilling and setting devices. Advantageously, the method according to the invention is realized in a manner that the start of an anchor drilling and setting procedure is enabled upon completion of the horizontal movement of the machine or cantilever arm into the mine face. Overall, only a short span is thus unavailable for the actuation of the anchor drilling and setting device during advance working or material winning, and it is feasible in the main to realize an effective securement of the roof in the immediate vicinity of the mine face at a high speed.

As initially mentioned, the device according to the invention for carrying out the above method requires a tunneling or mining machine in which a pivotable cantilever arm to which a cutting cylinder is rotationally mounted is provided, thus implying a defined operation method of such a tunneling or mining machine. Such devices, in fact, serve to make a break-in cut near the roof first and continue winning or advance working after this by vertically pivoting or, when using a cutting head, horizontally and vertically pivoting the cantilever arm. The device according to the invention is essentially characterized in that the control means for the excavation of material on the mine face is networked with the control means for the actuation of the anchor drilling and setting device via radio, electrical or optical lines. The type of control means respectively chosen for the excavation of material and for the actuation of the anchor drilling and setting devices in this case is freely selectable within a broad range, wherein known control means for the excavation of material and known control means for the actuation of anchor drilling and setting devices are applicable, it being merely required to appropriately network these means in order to ensure the mutual blockage at critical moments of the cutting or advancing procedure, respectively. In an advantageous manner, the device is further developed such that the anchor drilling and setting devices comprise at least one optionally remotely controllable switch for starting the drilling cycle, a filling procedure for introducing adhesive cartridges and a setting procedure for screwing in an anchor bolt.

In order to ensure the particularly rapid securement of the roof and keep the time required for the anchor drilling and setting procedure as short as possible, the configuration advantageously is devised such that the anchor drilling and setting devices comprise at least two relatively movable separate carriages for the vertical displacement of the manipulator and the drill rod assembly and the anchor, and that at least one rotation drive is provided for the drill rod assembly and the anchor, said carriages advantageously being equipped with at least two separate end switches for the limitation of the strokes of the rotation drives. Such a structural configuration of the device renders feasible the particularly simple and quick automated controlling, wherein the configuration, with a view to increasing the operating safety, may be devised such that separate switches are provided for the drilling cycle and the anchoring cycle. Separate switches in this context suggest not only separate end switches for the two cycles, but also separate switches for the start of the respective method step, namely the drilling cycle or the anchoring cycle.

Based on such a device, it is feasible in a particularly advantageous manner to devise the configuration such that the control means for the anchor drilling and setting devices comprise timers for the automatic execution of the respective cycle, wherein the second carriage is switched to a defined downward movement between the end of the drilling cycle and prior to the pivotal movement of the manipulator into an anchoring position, whereupon, after the start of the anchoring cycle for the final partial stroke of the movement of the anchor, the second carriage after a defined time-controlled waiting step, upon switching on of a rotation drive, is switched to an upward movement and capable of being moved back into the lowered position subsequently. By pivoting the manipulator between the individual cycles for drilling, introducing the adhesive cartridges and anchoring, a collision with the roof can be prevented, wherein a particularly quick and simple automatic control of the anchor drilling and setting procedure at a simultaneous cutting procedure is feasible in that the lifting movements of the carriages are controlled by end switches and timers.

In the following, the invention will be explained in more detail by way of an exemplary embodiment schematically illustrated in the drawing as well as an exemplary embodiment for carrying out the control method. In the drawing, FIG. 1 is a side view of a cutting machine comprising anchor drilling and setting devices supported on the machine frame; and FIG. 2 is a top view on the illustration according to FIG. 1.

Figure 2:
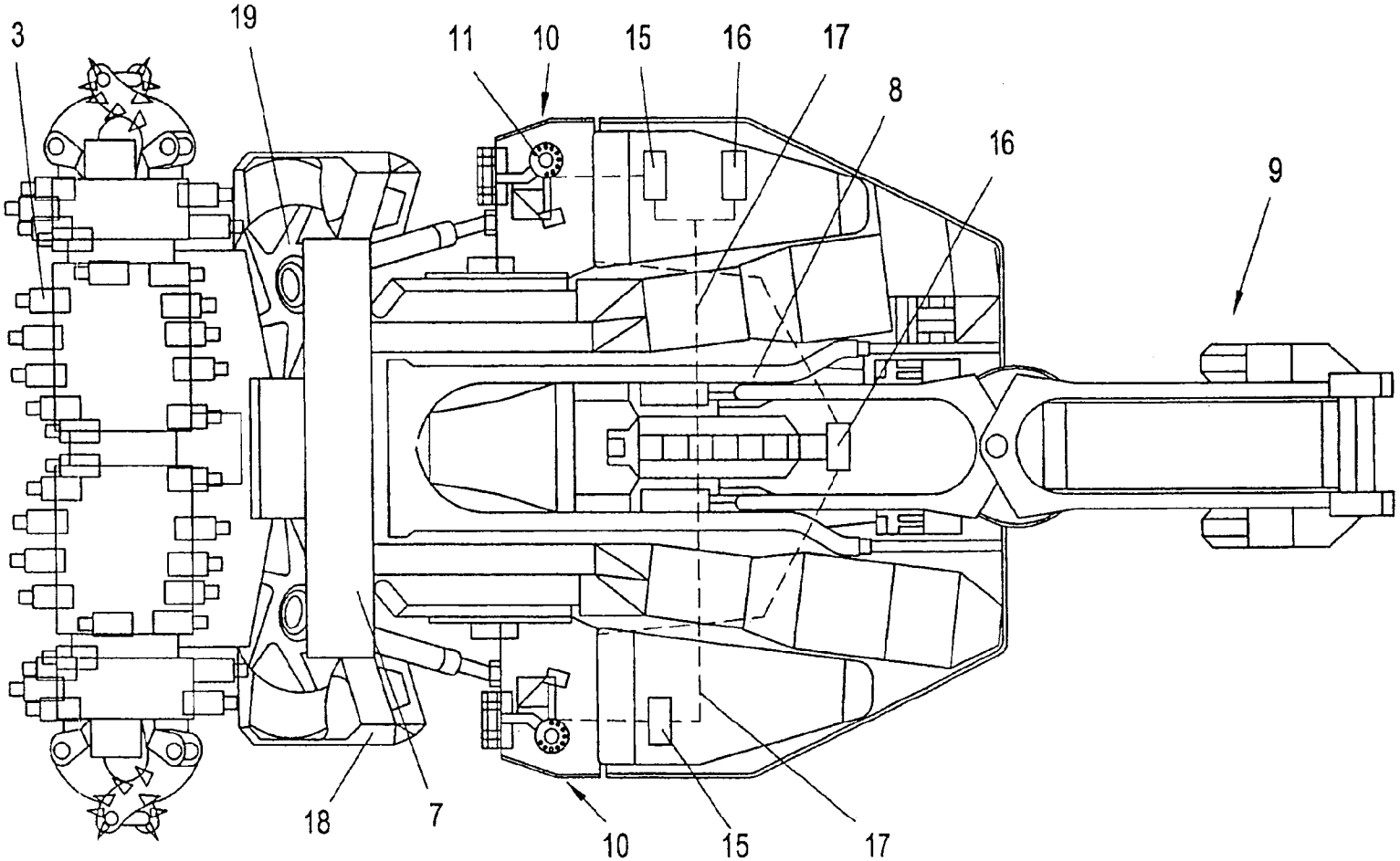

FIG. 1 depicts a cutting machine 1, which is movable on a crawler mechanism 2 in the longitudinal direction of the track. A cutting cylinder 3 rotationally mounted on a cantilever arm 4 is provided to work the mine face, the rotation drive being housed within the cantilever arm 4. The cantilever arm 4 is pivotable in the vertical direction in the sense of double arrow 5 so as to move the excavation tools over the mine face. Prior to the beginning of an excavation step the cutting tools must be introduced into the mine face, to which end a break-in cutting step is carried out, usually by advancing the cutting cylinder 3 in a manner that more than half of the cylinder will penetrate into the mince face, before the cutting procedure proper is commenced by a downward pivotal movement in the sense of double arrow 5. Break-in cutting, as a rule, is performed close to the roof by lifting the cutter arm 4 into the appropriate position for the break-in cut.

Supporting props 6, via which a roof bar 7 can be pressed at the roof in order to stabilize the machine within the track, bear against the machine frame. Furthermore, an additional supporting prop 8 is visible, via which the roof bar is articulately supported on the rear end of the machine.

A haulage means, via which the cut material is thrown onto conveying means arranged within the track such as, for instance, conveying belts or conveying cars, is schematically illustrated at 9 on the rear end of the machine.

Near the mine face, anchor drilling and setting devices 10 are arranged on the machine frame, with an anchor 11 stored in a magazine and the associated manipulator 12 being apparent from the side view according to FIG. 1. The manipulator 12 is displaceable in the vertical direction by means of a first carriage 13. On said first carriage 13, a second carriage 14 is displaceable in the vertical direction relative to the first carriage 13. The manipulator is designed to be pivotable about a substantially vertical axis in order to be able to assume the respectively aligned position with the anchor borehole for the various steps of drilling and anchoring and introducing adhesive cartridges, respectively, and in order to be able to remove anchors 11 from the respective magazine.

In the illustration according to FIG. 1, a control means for the anchor drilling and setting devices is, furthermore, schematically indicated at 15, which monitors and controls the automated and programmed sequence of the individual cycles during drilling and anchoring. Finally, the respective control means for the operation of the cutting cylinder 3 is indicated at 16, via which the individual method steps during cutting are optionally automatically controlled. At 17, the pertinent network line which connects control means 15 and 16 in a manner that the two means will respectively receive full information on the respective working step of the different devices is indicated.

From the top view according to FIG. 2, a loading ramp 18 is finally apparent, via which the cut material is taken up from the floor, wherein loading arms 19 convey to a haulage means the material taken up via the loading ramp 18.

In principle, any known control means can be used for the control means 15 and 16, the method sequence for controlling essentially comprising the following steps:

1. The support and, in particular, the roof bar 7 are positioned and pressed at the roof, whereupon the drill bit of a drill rod of the anchor drilling and setting device 10 is pivoted into the appropriate position. In this first step, also the positioning of the drill bit may already be effected by moving the carriages 13 and 14. The release of the drilling cycle is effected following the appropriate message by the control means 16 via line 17, according to which break-in cutting has been completed and the cutting operation proper has started by the downward pivotal movement of the cantilever arm 4 in the sense of double arrow 5. Upon release, either an appropriate enabling signal may be generated or the drilling cycle may be started at once.

2. At the beginning of the drilling cycle, the drill bit is, at first, driven into the roof in a time-controlled manner over a predetermined period of time of, for instance, 2 seconds at low speed and a short advance.

3. Immediately after this, the regular drilling procedure takes place with the advance and advance speed being controllable via the hydraulic pressure or flow rate.

4. After the upward movement of the drilling machine on the carriage 14 into its upper end position, in which an end switch may, for instance, be actuated, the number of revolution is reduced and the drill rod is retracted again. At that moment, the second carriage 14 is in its upper end position, which may again be controlled by a separate end switch. Then is positioned the nose piece of a hose through which a fluid, e.g. air under pressure, and adhesive cartridges are introduced. After this, the nose piece of the hose is again pivoted back.

In the third phase of the operating movements of the anchor drilling and setting device, the consecutive method steps can be initiated either automatically immediately thereupon or by actuating a further switch.

5. After having lowered the second carriage 14 by a defined path or over a defined time of, for instance, 4 seconds, in order to avoid any impediment of the pivotal movement of the manipulator, an anchor bolt is removed from a carrousel or magazine.

6. The threaded drive on the carriage 14 is moved in the vertical direction and the anchor rod is released by the manipulator so as to enable its introduction initially without rotation at an interval of seconds and then under rotation. The upward movement of the anchor bolt is again effected until the actuation of a separate switch. By the rotary movement and further upward movement of the anchor bolt, the adhesive cartridges are destroyed and the emerging material is accordingly blended.

7. After having reached the end position of the first carriage 13, the second carriage 14 is moved upwards over a predetermined period of time of, for instance, 5 seconds, with the rotation drive intended to turn in the anchor bolt remaining activated until the predetermined time of blending of the adhesive has been attained.

8. A waiting cycle of, for instance, 20 seconds is switched on for the adhesive resin to harden.

9. The rotation drive for the anchor bolt is again activated over a defined period of time of, for instance, 2 seconds in order to tighten the anchor bolt.

10. The second carriage 14 is again lowered as far as to the mechanical end stop. After this, the threaded drive is retracted into its lower end position, whereby an end switch may again be actuated in this case. When using separate drives for the drilling motor and the tightening of the anchor bolts, the drilling motor is subsequently pivoted in again.

A further working cycle takes place after the cutting machine has reached a new position, i.e. following a further break-in cutting procedure, wherein the distance over which an anchorage is effected—viewed in the longitudinal direction of the track—depends on the nature of the material of the roof, anchoring being not necessarily required after each new break-in cutting procedure, but only after a multiple of such break-in cutting procedures.

The termination of the working cycles of the anchor drilling and setting device is again appropriately signalized in order to indicate that the roof has now been secured and a new break-in cutting procedure may be effected. During those phases of the process, all of the devices and means are the region secured by anchors such that the respective magazines can again be filled with anchor rods and the respectively correct starting position for the automatic sequence of the working cycles during anchoring and drilling can be resumed.

The operators will be in a dust- and noise-protected cabin during anchoring off. By using radio remote control for the control of the anchor drilling and setting device and the tunneling or mining machine, any control may also be effected from above ground.

What is claimed is:

1. A method for drilling and setting adhesive anchor bolts close to a mine face during a cutting operation of a tunneling or mining machine (1) capable of being displaced on a traveling mechanism (2) and including a cutting cylinder (3) or cutting head rotationally mounted on a cantilever arm (4) pivotable in a vertical direction (5), and optionally in a horizontal direction, comprising the steps of detecting a substantially horizontal forward movement of the cantilever arm (4) during break-in cutting, and generating a signal during break-in cutting to block commencement of a working cycle for drilling and anchoring.

2. A method according to claim 1, wherein commencement of an anchor drilling and setting procedure is enabled upon completion of the horizontal movement of the cantilever arm (4) into the mine face.

3. A device for drilling and setting adhesive anchor bolts close to a mine face during a cutting operation of a tunneling or mining machine (1) capable of being displaced on a traveling mechanism (2) and including a cutting cylinder (3) or cutting head rotationally mounted on a cantilever arm (4) pivotable in a vertical direction (5), and optionally in a horizontal direction, comprising means for detecting a substantially horizontal forward movement of the cantilever arm (4) during break-in cutting;

means for generating a signal during break-in cutting to black commencement of a working cycle for drilling and anchoring; and means for controlling excavation of material (16) on the mine face networked with means for controlling actuation (15) of at least one anchor drilling and setting device (10) via at least one of radio, electrical, and optical lines.

4. A device according to claim 3, wherein the at least one anchor drilling and setting device (10) comprises at least one, optionally remotely controllable, switch for starting a drilling cycle, a filling procedure for introduction of adhesive cartridges, and a setting procedure for screwing in an anchor bolt.

5. A device according to claim 4, wherein the at least one anchor drilling and setting device (10) comprises a plurality of relatively movable separate carriages (13, 14) for vertical displacement of a manipulator (12) and a drill rod assembly and an anchor (11), and at least one rotation drive is provided for the drill rod assembly and the anchor (11).

6. A device according to claim 5, wherein the carriages (13, 14) comprise at least two separate end switches for limitation of strokes.

7. A device according to claim 6, comprising separate switches for the drilling cycle and for an anchoring cycle.

8. A device according to claim 7, wherein the means for controlling actuation (15) of the least one anchor drilling and setting device (10) comprises at least one timer for automatic execution of drilling cycles and anchoring cycles, wherein a second carriage (14) is switched to a defined downward movement between end of the drilling cycle and prior to pivotal movement of the manipulator (12) into an anchoring position, whereupon, after commencement of the anchoring cycle for a final partial stroke of movement of the anchor (11), the second carriage (14) after a defined time-controlled waiting step, upon switching on of a rotation drive, is switched to an upward movement and is capable of being moved back into a lowered position subsequently.

9. A device according to claim 6, wherein the means for controlling actuation (15) of the at least one anchor drilling and setting device (10) comprises at least one timer for automatic execution of drilling cycles and anchoring cycles, wherein a second carriage (14) is switched to a defined downward movement between end of the drilling cycle and prior to pivotal movement of the manipulator (12) into an anchoring position, whereupon, after commencement of the anchoring cycle for a final partial stroke of movement of the anchor (11), the second carriage (14) after a defined time-controlled waiting step, upon switching on of a rotation drive, is switched to an upward movement and is capable of being moved back into a lowered position subsequently.

10. A device according to claim 6, wherein lifting movements of the carriages (13, 14) are controlled by end switches and timers.

11. A device according to claim 5, comprising separate switches for the drilling cycle and for an anchoring cycle.

12. A device according to claim 11, wherein the means for controlling actuation (15) of the at least one anchor drilling and setting device (10) comprises at least one timer for automatic execution of drilling cycles and anchoring cycles, wherein a second carriage (14) is switched to a defined downward movement between end of the drilling cycle and prior to pivotal movement of the manipulator (12) into an anchoring position, whereupon, after commencement of the anchoring cycle for a final partial stroke of movement of the anchor (11), the second carriage (14) after a defined time-controlled waiting step, upon switching on of a rotation.

13. A device according to claim 11, wherein lifting movements of the carriage (13, 14) are controlled by end switches and timers.

14. A device according to claim 5, wherein the means for controlling actuation (15) of the at least one anchor drilling and setting device (10) comprises at least one timer for automatic execution of drilling cycles and anchoring cycles, wherein a second carriage (14) is switched to a defined downward movement between end of the drilling cycle and prior to pivotal movement of the manipulator (12) into an anchoring position, whereupon, after commencement of the anchoring cycle for a final partial stroke of movement of the anchor (11), the second carriage (14) after a defined time-controlled waiting step, upon switching on of a rotation drive, is switched to an upward movement and is capable of being moved back into a lowered position subsequently.

15. A device according to claim 5, wherein lifting movements of the carriages (13, 14) are controlled by end switches and timers.

16. A device according to claim 4, comprising separate switches for the drilling cycle and for an anchoring cycle.

17. A device according to claim 16, wherein the means for controlling actuation (15) of the at least one anchor drilling and setting device (10) comprises at least one timer for automatic execution of drilling cycles and anchoring cycles, wherein a second carriage (14) is switched to a defined downward movement between end of the drilling cycle and prior to pivotal movement of the manipulator (12) into an anchoring position, whereupon, after commencement of the anchoring cycle for a final partial stroke of movement of the anchor (11), the second carriage (14) after a defined time-controlled waiting step, upon switching on of a rotation drive, is switched to an upward movement and is capable of being moved back into a lowered position subsequently.

18. A device according to claim 16, wherein lifting movements of the carriages (13, 14) are controlled by end switches and timers.

19. A device according to claim 3, wherein the at least one anchor drilling and setting device (10) comprises a plurality of relatively movable separate carriages (13, 14) for vertical displacement of a manipulator (12) and a drill rod assembly and an anchor (11), and at least one rotation drive is provided for the drill rod assembly and the anchor (11).

20. A device according to claim 19, wherein the carriages (13, 14) comprise at least two separate end switches for limitation of strokes.

21. A device according to claim 20, comprising separate switches for the drilling cycle and for an anchoring cycle.

22. A device according to claim 21, wherein the means for controlling actuation (15) of the at least one anchor drilling and setting device (10) comprises at least one timer for automatic execution of drilling cycles and anchoring cycles, wherein a second carriage (14) is switched to a defined downward movement between end of the drilling cycle and prior to pivot movement of the manipulate (12) into an anchoring position, whereupon, after commencement of the anchoring cycle for a final partial stroke of movement of the anchor (11), the second carriage 14) after a defined time-controlled waiting step, upon switching on of a rotation drive, is switched to an upward movement and is capable of being moved back into a lowered position subsequently.

23. A device according to claim 21, wherein lifting movements of the carriages (13, 14) are controlled by end switches and timers.

24. A device according to claim 20, wherein the means for controlling actuation (15) of the at least one anchor drilling and setting device (10) comprises at least one timer for automatic execution of drilling cycles and anchoring cycles, wherein a second carriage (14) is switched to a defined downward movement between end of the drilling cycle and prior to pivotal movement of the manipulator (12) into an anchoring position, whereupon, after commencement of the anchoring cycle for a final partial stroke of movement of the anchor (11), the second carriage (14) after a defined time-controlled waiting step, upon switching on of a rotation drive, is switched to an upward movement and is capable of being moved back into a lowered position subsequently.

25. A device according to claim 20, wherein lifting movements of the carriages (13, 14) are controlled by end switches and timers.

26. A device according to claim 19, comprising separate switches for the drilling cycle and for an anchoring cycle.

27. A device according to claim 26, wherein the means for controlling actuation (15) of the at least one anchor drilling and setting device (10) comprises at least one timer for automatic execution of drilling cycles and anchoring cycles, wherein a second carnage (14) is switched to a defined downward movement between end of the drilling cycle and prior to pivotal movement of the manipulator (12) into an anchoring position, whereupon, after commencement of the anchoring cycle for a final partial stroke of movement of the anchor (11), the second carnage (14) after a defined time-controlled waiting step, upon switching on of a rotation drive, is switched to an upward movement and is capable of being moved back into a lowered position subsequently.

28. A device according to claim 26, wherein lifting movements of the carriages (13, 14) are controlled by end switches and timers.

29. A device according to claim 19, wherein the means for controlling actuation (15) of the at least one anchor drilling and setting device (10) comprises at least one timer for automatic execution of drilling cycles and anchoring cycles, wherein a second carriage (14) is switched to a defined downward movement between end of the drilling cycle and prior to pivotal movement of the manipulator (12) into an anchoring position, whereupon, after commencement of the anchoring cycle for a final partial stroke of movement of the anchor (11), the second carriage (14) after a defined time-controlled waiting step, upon switching on of a rotation drive, is switched to an upward movement and is capable of being moved back into a lowered position subsequently.

30. A device according to claim 29, wherein lifting movements of the carriages (13, 14) are controlled by end switches and timers.

31. A device according to claim 19, wherein lifting movements of the carriages (13, 14) are controlled by end switches and timers.

* * * * *